United States Patent [19]

Delattre et al.

[11] Patent Number: 4,612,732

[45] Date of Patent: Sep. 23, 1986

[54] MACHINE FOR GRINDING OPHTHALMIC LENSES

[75] Inventors: Luc Delattre, Pont Ste Maxence; Jean-François Moulin, Ris Orangis; Suzan Badin, Savigny-le-Temple, all of France

[73] Assignee: Essilor International Cie Generale d'Optique, Creteil, France

[21] Appl. No.: 739,365

[22] Filed: May 30, 1985

[30] Foreign Application Priority Data

Jun. 4, 1984 [FR] France ..... 84 08711

[51] Int. Cl.[4] ..... B24B 9/14

[52] U.S. Cl. ..... 51/101 LG; 51/105 LG; 51/284 E

[58] Field of Search ..... 51/101 LG, 105 LG, 124 L, 51/101 R, 106 LG, 284 E, 165.71

[56] References Cited

U.S. PATENT DOCUMENTS

| | | | |
|---|---|---|---|
| 2,028,315 | 1/1936 | Brühl et al. | 51/101 R |
| 2,144,205 | 3/1938 | Tandy | 51/101 LG |
| 4,528,780 | 7/1985 | Halberschmidt | 51/101 R |

*Primary Examiner*—Robert P. Olszewski
*Assistant Examiner*—Maurina Rachuba
*Attorney, Agent, or Firm*—Charles E. Brown; Charles A. Brown

[57] ABSTRACT

A machine for grinding ophthalmic lenses comprises a frame and a support to which an ophthalmic lens to be processed may be attached pivoted to the frame about an axis parallel to the axis of the grinding tool. A counterweight on the support is movable relative to the frame in a direction orthogonal to the pivot axis. A drive device controls movement of the counterweight. A guide cam is disposed on the path of movement of the counterweight. The machine may be used for trimming and/or bevelling or grooving an ophthalmic lens.

19 Claims, 15 Drawing Figures

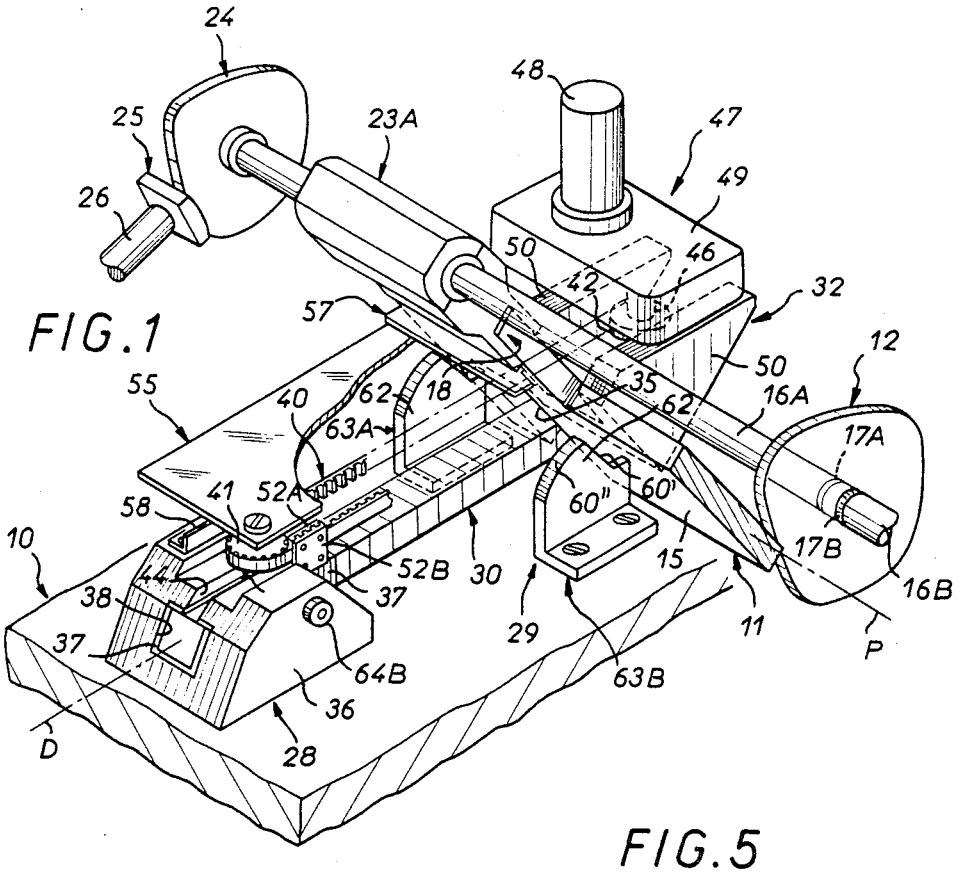
FIG. 1
FIG. 5
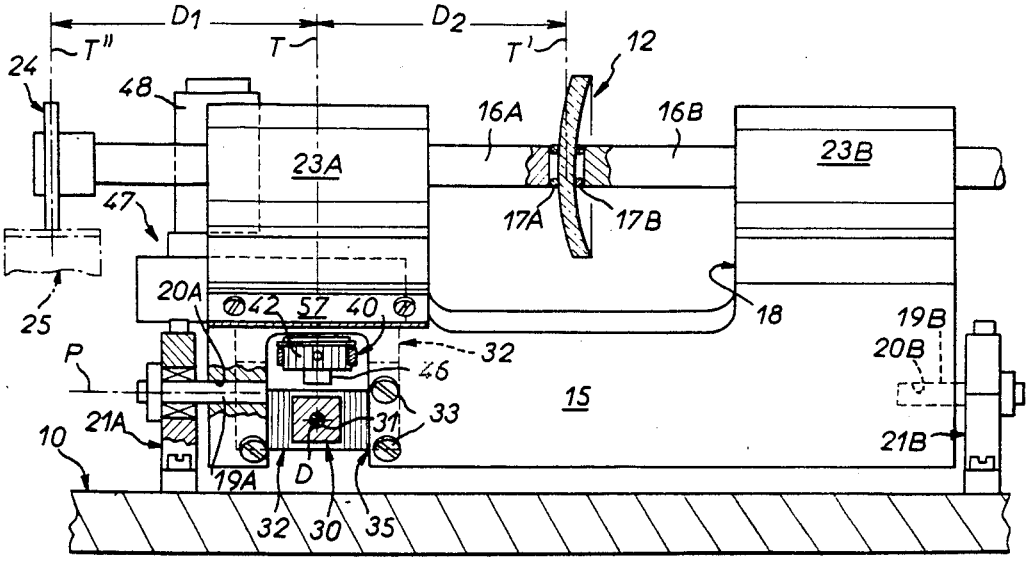

MACHINE FOR GRINDING OPHTHALMIC LENSES

BACKGROUND OF THE INVENTION

1. Field of the Invention

The present invention generally concerns the grinding of the peripheral edge of an ophthalmic lens, whether this is to trim, bevel or groove it.

2. Description of the Prior Art

As is known, in order to match an ophthalmic lens to the contour of the ring or surround of the spectacle frame in which it must be mounted, it has to be appropriately trimmed, that is to say it must have conferred on it a contour which is an image of that of this ring or surround.

As is also known, when the ring or surround comprises an annular groove, commonly referred to as a bezel, in order to retain the ophthalmic lens, it is necessary to form on the peripheral edge of the ophthalmic lens, after it is trimmed, a rib or bevel, generally triangular in transverse cross-section, appropriate to its engagement in said groove.

Likewise, it is necessary to form a groove in it when the ring or surround of the spectacle frame concerned comprises a projecting tang for retaining it and/or when a flexible filament or binding of some kind to fit round the lens is associated with the ring or surround.

More often than not the trimming and bevelling or grooving thus required are carried out on a grinding machine which is equipped to this end with at least one appropriate grinding tool at a grinding station.

On a grinding machine of this kind, the ophthalmic lens to be processed is held with its edge in contact with a grinding tool and it is rotated on itself about an axis parallel to the axis of the tool.

In practice, the grinding machines employed usually comprise, for this purpose, at the grinding station, a support, commonly referred to as a bascule, to which the ophthalmic lens to be processed may be attached and which, in order to apply the lens to the grinding tool concerned, is pivotally mounted on the frame of the assembly, to pivot about an axis parallel to the axis of said grinding tool.

In practice the support employed comprises two shafts between which the ophthalmic lens to be processed may be inserted, to hold and rotate it, and with one of which a template is constrained to rotate.

This template, which has the same contour as the ring or surround of the spectacle frame to be equipped, is provided so as to delimit during trimming the depth of penetration to be observed for the grinding tool used, and to this end it bears on a follower with which it remains in contact at all times during the bevelling or grooving which follows on from such trimming.

When not in use, the support is naturally moved away from the grinding tool or tools at the grinding station.

Thus after fitting an ophthalmic lens to a support of this kind, the support must be pivoted to lower the ophthalmic lens into contact with the grinding tool for carrying out the initial trimming.

Then, following the bevelling or grooving of the processed ophthalmic lens, the support must be raised before the ophthalmic lens is removed from it.

At present, these operations are more often than not carried out manually.

They therefore require a relatively experienced operator, both to initiate the processing of an ophthalmic lens and to terminate it, and the operator is mobilized for a relatively long and therefore expensive period each time.

In French patent application No. 80 09808 filed Apr. 30, 1980 and published under the number 2.481.635 it is proposed to raise the support carrying the processed ophthalmic lens on completion of its processing by means of the follower associated with the template, which to this end is made mobile in order to push back the template in contact with it and, through the intermediary of the latter, the support.

However, to raise the support sufficiently the travel of the follower must be relatively great, which significantly complicates the assembly.

In French Pat. No. 1.240.167 the carriage or support carrying the part or lens processed is raised by means of a counterweight which, movably mounted on a rod, is released at the end of a predetermined time under the control of a cam.

Apart from the fact that a counterweight of this kind is operative only on an "on or off" basis and only for raising the support, the initial lowering of the support needed to initiate the processing must still be done manually.

The same applies to U.S. Pat. No. 2,528,952 in which a counterweight movably mounted under the control of actuator means is provided only for appropriate adjustment of the contact pressure between the lens being processed and the corresponding grinding tool while the processing is being done.

A general object of the present invention is an arrangement enabling these disadvantages to be avoided and further conferring other advantages.

SUMMARY OF THE INVENTION

The present invention consists in a machine for grinding ophthalmic lenses comprising a frame, a grinding tool, a support to which an ophthalmic lens to be processed may be attached pivoted to said frame about an axis parallel to the axis of said grinding tool, a counterweight on said support movable relative thereto in a direction orthogonal to said pivot axis, drive means controlling movement of said counterweight, and a guide cam supported by said frame on the path of movement of said counterweight.

Thus it is the conjoint action of the counterweight and the associated guide cam which, on displacement of the counterweight over the support carrying the ophthalmic lens to be processed, initially lowers the support, to bring the ophthalmic lens into contact with the grinding tool concerned, and then raises it, after the ophthalmic lens has been processed.

As the movement of the counterweight may be executed automatically, under the control of a drive motor-gearbox system for example, all the operator needs to do to initiate a work cycle is to start up the drive system.

The corresponding operation is instantaneous and no subsequent intervention by the operator is then needed.

Furthermore, the counterweight thus employed in accordance with the invention provides for optimum adjustment of the contact pressure with which the ophthalmic lens to be processed is applied against a grinding tool.

Such adjustment of this contact pressure is of practical benefit.

Given the nature of the material constituting the ophthalmic lens to be processed and the diameter of the lens and that of the grinding tool, if the contact pressure is too low, for example, the time needed to process the ophthalmic lens is too long, which is costly, whereas if the contact pressure is too high, the conditions under which the ophthalmic lens is processed may be prejudicial to its integrity.

In accordance with the invention, all that is needed is to adjust the position of the counterweight as appropriate.

The position selected for the counterweight may remain unchanged throughout the processing of the ophthalmic lens concerned.

Alternatively, in accordance with a further feature of the invention, it may be modified during processing so that in spite of the changing radius of curvature of the contour of the ophthalmic lens while it is being processed, the contact pressure on the corresponding griding tool remains substantially constant, in particular when the template employed is relatively flexible.

Other objects and advantages will appear from the following description of examples of the invention, when considered in connection with the accompanying drawings, and the novel features will be particularly pointed out in the appended claims.

BRIEF DESCRIPTION OF THE DRAWINGS

FIG. 1 is a locally cutaway partial view in perspective of the grinding station of a grinding machine in accordance with the invention.

FIG. 5 is a schematic view of it in elevation and in cross-section on the line V—V in FIG. 2.

DESCRIPTION OF THE PREFERRED EMBODIMENTS

Figure 2:
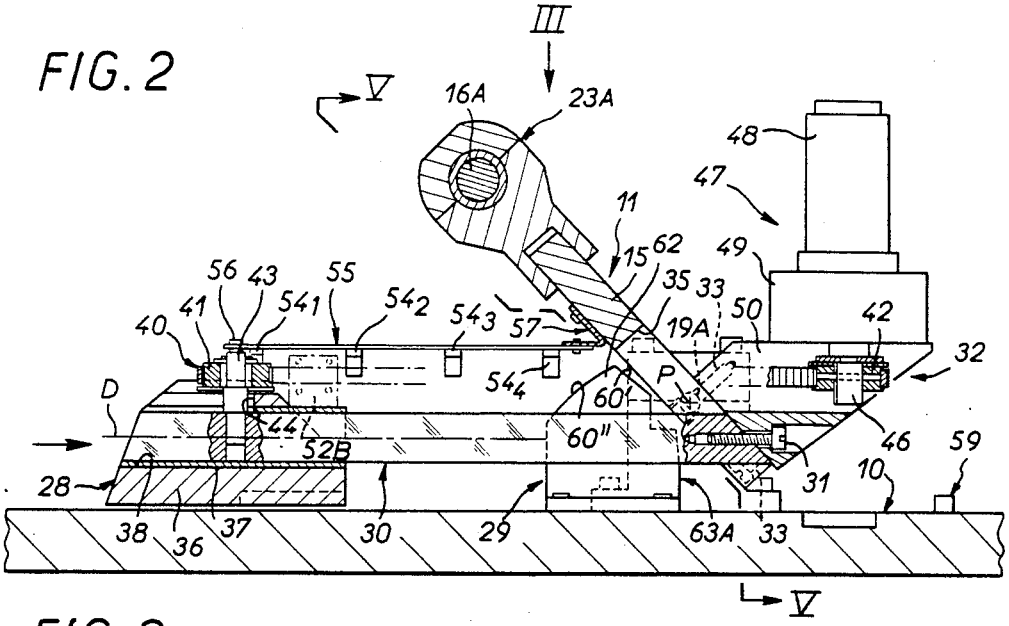
FIG. 2 is a view of this grinding station in transverse cross-section on the line II—II in FIG. 3.

As schematically illustrated in the figures, the grinding machine in accordance with the invention generally comprises a frame 10 and, at a grinding station carried by the frame 10, a support 11 to which may be attached an ophthalmic lens 12 to be trimmed, bevelled or grooved and which, in order to apply the ophthalmic lens 12 against any appropriate grinding tool, is pivotally mounted on said frame 10 to pivot about an axis parallel to the axis of said grinding tool.

As the frame 10 does not of itself constitute part of the present invention, and as its construction for the most part will be obvious to the man skilled in the art, it will not be described in detail here.

In practice, only part of this frame is visible in the figures, comprising a section of the top of a table.

The grinding tool or tools employed also do not constitute part of the present invention, and they will not be described here either.

Only part of the contour of a grinding tool of this kind is schematically represented in chain-dotted line in FIG. 6, under the reference numeral 13.

In the embodiments shown, the support 11 comprises a plate 15, by means of which it is pivoted to the frame 10, and which carries two shafts 16A, 16B aligned with one another for holding the ophthalmic lens 12 to be processed, the ophthalmic lens 12 being held between them by means of O-rings 17A, 17B and inserted through a notch 18 in the plate 15.

The plate 15, the contour of which is generally rectangular, comprises, for the purpose of pivoting it to the frame 10, two journals 19A, 19B projecting from two opposite sides which may, for example, simply be force-fitted into holes 20A, 20B formed in the thickness of the plate 15 and which are respectively mounted rotatably in bearings 21A, 21B carried to this end by the frame 10.

The corresponding pivot axis P of the plate 15 and thus of the support 11 is schematically represented in chain-dotted line in FIGS. 1, 3, 4 and 5 and its position is also indicated in FIGS. 2 and 6.

The shafts 16A, 16B are rotatably mounted on the plate 15.

To this end, in the embodiments shown each is inserted in a respective bush 23A, 23B which, in the manner of coping stones, are appropriately attached to the edge of the plate 15 opposite that in the vicinity of which its pivot axis P is located.

By virtue of arrangements which are well known per se and which will therefore not be described here, the shafts 16A, 16B are mobile axially relative to one another, for the purpose of inserting and removing the ophthalmic lens 12 to be processed.

A template 24 is removably constrained to rotate with one of these shafts, in this instance with shaft 16A, and thus through the latter with the ophthalmic lens 12 to be processed. Its contour is an image of the ring or surround of the spectacle frame in which the ophthalmic lens 12 to be processed is to be fitted.

As schematically represented in FIG. 1, the template 24 is designed to bear on a follower 25 mounted on a rod 26.

By virtue of arrangements which are well known per se and, forming no part of the present invention, will not be described here, this rod 26 is axially mobile, under the control of a specific stepper motor, for example.

In accordance with the invention, a counterweight 28, hereinafter referred to for convenience as the application counterweight, is mounted on the support 11 so as to be mobile in a direction D orthagonal to the pivot axis P, under the control of drive means to be explained hereinafter. Disposed on the path of movement of said application counterweight 28 is a cam 29, hereinafter referred to for convenience as the guide cam, carried by the frame 10.

Figure 3:
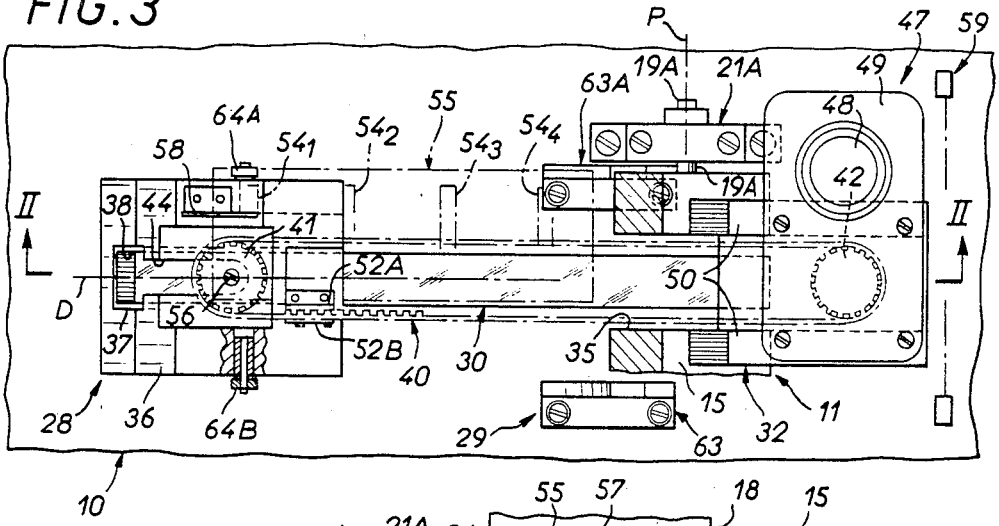
FIG. 3 is a partial plan view of it in the direction of the arrow III in FIG. 2, with certain parts removed.

The direction of displacement D of the application counterweight 28 is schematically represented in chain-dotted line in FIGS. 1 through 3.

Figure 4:
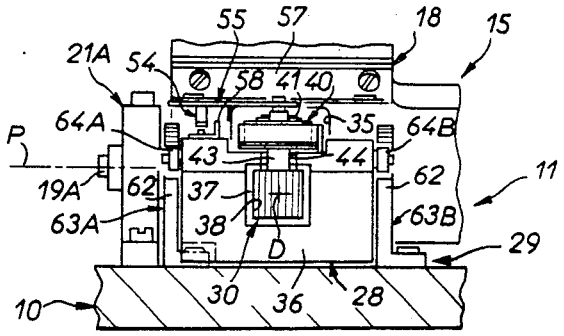
FIG. 4 is a partial view of it in elevation in the direction of the arrow IV in FIG. 2.

It is also schematically represented by its position in FIGS. 4 and 5.

In practice, in the embodiments shown, the application counterweight 28 is slidably mounted on a straight guide 30 of square transverse cross-section which is carried by the support 11, extending obliquely relative to the plate 15 forming part of the latter.

For example, and as shown here, this guide 30 is attached by a screw 31 to a bracket 32 which, itself attached by screws 33 to the plate 15, extends over the surface of said plate 15 opposite that over which the guide 30 extends, said guide 30 passing through said plate 15 by means of a notch 35 in the latter.

For preference and as shown here, and for reasons which will be explained hereinafter, the arrangements are such that the transverse plane T perpendicular to the pivot axis P of the support 11 which contains the axis of the guide 30, and thus the direction of displacement D of the application counterweight 28, constitutes a medium plane in relation to, on the one hand, the ophthalmic lens 12 to be processed, or in other words a transverse plane T' in which the lens is held between the shafts 16A, 16B and, on the other hand, the template 24, or in other words the transverse plane T'' in which the latter bears on the follower 25 associated with it.

For greater clarity the transverse planes T, T', T'' have been schematically represented in chain-dotted line in FIG. 5.

The distances D1, D2 which separate them are thus equal.

In practice, in the embodiments shown, the application counterweight 28 comprises, on the one hand, a weight 36 of generally trapezoidal lateral contour and, on the other hand, a sheath 37 which is force fitted into an opening 38 in said weight 36 and by which it is slidably engaged on the guide 30 which is associated with it.

Moreover, in the embodiments shown, the drive means for the application counterweight 28 comprise a belt 40 which is engaged with said application counterweight 28 and which passes in an endless loop over two rotary rollers 41, 42 of which one, the roller 41, is an idler roller on the guide 30, at the end of the latter, being in practice rotatably mounted on a spindle 43 attached to said guide 30 perpendicularly to its direction of displacement D, by virtue of a notch 44 in the application counterweight 28, and the other of which, the roller 42, is constrained to rotate with the output shaft 46 of a drive system 47, comprising a motor 48 and gearbox 49, for example, carried by the bracket 32, said belt 40 passing like the guide 30, and generally parallel to the latter, through the plate 15 by virtue of the notch 35 in the latter.

In the embodiment specifically shown in FIGS. 1 through 5, the spindles of the rollers 41, 42 of the belt 40 are vertical.

They are thus parallel to the plate constituting the frame 10.

Also, in this embodiment, the bracket 32 features two parallel legs 50 between which extends the output shaft 46 of said drive system 47, in the direction towards the frame 10.

In practice, in the embodiment shown, the belt 40 is a notched belt and the application counterweight 28 comprises two jaws 52A, 52B which are in practice carried by its sheath 37 and between which said notched belt 40 passes, one of said jaws 52A, 52B, in this instance the jaw 52A, having a notched profile complementary to that of the belt.

The rollers 41 and 42 naturally have appropriated profiles.

The drive system for the application counterweight 28 is preferably controlled by a programmable controller.

For example, this controller comprises at least one sensor 54 disposed on the path of movement of the application counterweight 28 or a movable member motionally coupled thereto and sensitive to movement thereof which is adapted, when the power supply of the drive system 47 for said application counterweight 28 has previously been activated, to disable temporarily said power supply.

In the embodiment specifically shown in FIGS. 1 through 5, a plurality of sensors $54_1$, $54_2$, $54_3$, $54_4$ are provided in this way, thus four in number in this embodiment, aligned along the path of movement of the application counterweight 28 and connected in parallel to the power supply of the drive system 47 for the counterweight.

In practice, these are photo-electric cells the emitter and receiver of which are attached to the lower surface of a common support plate 55 itself fastened to the support 11 and parallel to the guide 30.

In the embodiment shown, this support plate 55, which has been deliberately omitted from FIG. 3 and which carries a printed circuit for the sensors 54, is attached at one end to the spindle 43 of the roller 41 by means of a screw 56 and at the other end to the plate 15 by means of a bracket 57.

Conjointly, for the purposes of cooperation with the sensors 54, the application counterweight 28 carries a projecting plate 58 (FIGS. 1, 3 and 4) adapted to intercept the beam of the sensors when the application counterweight 28 moves on its guide 30.

The operation of the sensors 54 is governed by selectors, one for each sensor 54, available to the operator.

The practical implementation of an arrangement like this will be obvious to the man skilled in the art and will not be described here.

The same applies to the parallel connection of the sensors 54 to the power supply of the drive system 47.

Likewise, by virtue of arrangements which will not be described in detail here, the controller governing the drive system for the application counterweight 28 and more precisely the power supply of the drive system 47 of the latter, preferably comprise a supplementary sensor 59 which senses the position of the support 11 and is adapted to switch off said power supply at the end of a cycle.

As previously, this is in practice a photo-electric cell which is carried by the frame 10 in the vicinity of the bracket 32 carried by the support 11 so that this bracket 32 can intercept its beam at the end of the cycle, as will be more fully described hereinafter.

The guide cam 29 associated with the application counterweight 28 extends from the same side of the plate 15 as the guide 30, being carried by the frame 10, and is generally convex with its convex side facing away from said frame 10.

It thus features two ramp surfaces 60', 60'' disposed on respective sides of a peak region 62 which is common to them, with one of said ramps, in this instance the ramp 60', inclined towards the pivot axis P of the support 11 and the other, in this instance the ramp 60'', inclined in the direction away from this pivot axis P.

In practice, in the embodiment shown, the guide cam 29 is formed by the edges of two flanges 63A, 63B which project from the frame 10 and each of which forms, as shown, one of the wings of a bracket the other wing of which is used to fix it to the frame 10. They are disposed on respective sides of the guide 30 on which the application counterweight 28 is movably mounted and the counterweight features two laterally projecting pegs 64A, 64B, in practice rollers rotatably mounted at the end of journals, through which it is adapted to come into engagement with said edge of said flanges 63A, 63B.

Be this as it may, the peak region 62 of the guide cam 29 thus formed is disposed at a sufficiently high level for the ophthalmic lens 12 to be processed to be moved away from the corresponding grinding tool 13, irrespective of its diameter, when the application counterweight 28 is engaged with said peak area 62 of the guide cam 29. The same applies when the application counterweight 28 is engaged with the ramp 60' of the guide cam 29 which is inclined towards the pivot axis P of the support 11.

Figure 6A:
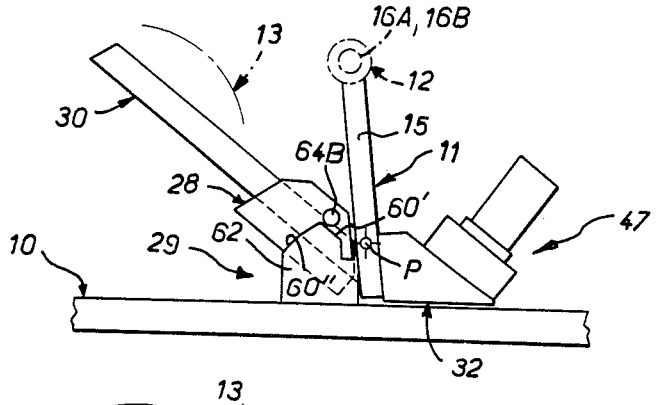
FIGS. 6A, 6B, 6C, 6D are view which generally correspond to that of FIG. 2 and schematically illustrate the operation of the counterweight which the grinding machine comprises.

As schematically represented in FIG. 6A, the corresponding position of the support 11 thus constitutes a waiting position, for placing the ophthalmic lens 12 to be processed between shafts 16A, 16B provided for this purpose on the support 11.

After selecting the sensor 54 to be used, the operator need only press a start pushbutton adapted to power up the power supply of the drive system 47 to initiate a processing cycle for the ophthalmic lens 12.

Moving then along its guide 30 due to the action of the notched belt 40, whilst bearing through its pegs 64A, 64B on the guide cam 29 which is associated with it, more precisely on the ramp 60' of the latter, the application counterweight 28 moves over the peak region 62 of the guide cam 29 and then follows the ramp 60'' of the guide cam 29, entraining by its self-weight the support 11 of which it forms part.

The application counterweight 28 thus of itself causes a pivoting movement of the support 11 around its pivot axis P, so ensuring that the support 11 is lowered in the direction towards the grinding tool 13 concerned.

Figure 6B:
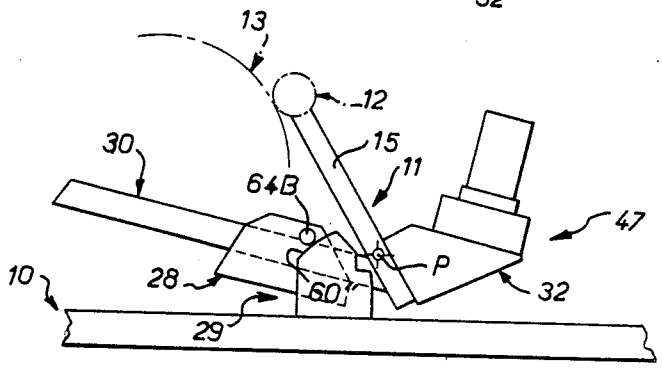

This movement of lowering the support 11 continues automatically until, as schematically represented in FIG. 6B, the edge of the ophthalmic lens 12 which it carries is applied against the grinding tool 13.

Figure 6C:
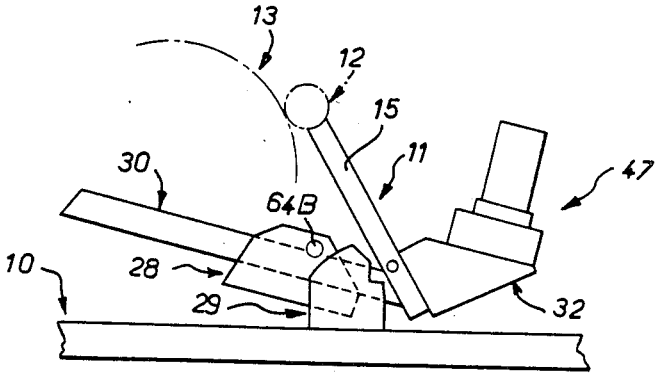

As the notched belt 40 continues to drive it, the application counterweight 28 continues to move along the guide 30, which causes the pegs 64A, 64B to leave the guide cam 29, or in other words to move away from the latter, as schematically shown in FIG. 6C.

This movement of the application counterweight 28 along its guide 30 continues until, the plate 58 which it carries coming into line with the previously selected sensor 54, the latter temporarily cuts off the power supply of the drive system 47.

The processing of the ophthalmic lens 12, already begun when it came into contact with the grinding tool 13 concerned, whether for the purpose of trimming or bevelling or grooving, then continues unrestrictedly according to a process which, well known per se, will not be described in detail here.

As is known, this process implies rotation of the ophthalmic lens 12 on itself in contact with the grinding tool 13, with the depth of penetration of the tool limited by the template 24, whilst, in order to follow the contour of the template, the support 11 oscillates about its pivot axis P, being urged at all times towards the grinding tool 13 by gravity.

As it is easy to understand, the contact pressure of the ophthalmic lens 12 on the grinding tool 13, which is at least in part due to the application counterweight 28, is proportional to the distance of the application counterweight 28 from the pivot axis P of the support 11.

In other words, the position of the application counterweight 28 during processing of the ophthalmic lens 12 being determined by the sensor 54 which terminates its movement along the guide 30, it is sufficient for the operator to select appropriately in advance that of the sensors 54 which corresponds to the required contact pressure.

For the sensor $54_4$, nearest the pivot axis P of the support 11, this contact pressure is relatively low (FIG. 6C) whereas for the sensor $54_1$, farthest from said pivot axis P, it is relatively high.

When processing of the ophthalmic lens 12 is terminated, the power supply to the drive system 47 resumes of its own accord.

For example, to this end the power supply may be governed by a sensor which, in conjunction with the template 24 and the follower 25 with which the latter is associated, comes into action when permanent contact of the template 24 on the follower 25 throughout a cycle of rotation of said template 24 and thus of the ophthalmic lens 12 is detected.

The follower 25 is then preferably employed for moderate raising of the support 11, prior to or simultaneous with the supply of power to the drive system 47.

Such moderate raising, which may cover only a few degrees, moves the ophthalmic lens 12 away from the grinding tool 13 sufficiently to avoid any unwanted formation of facets on its edge.

Be this as it may, urged on again by the notched belt 40, the application counterweight 28 then moves in the direction towards the pivot axis P of the support 11.

When the pegs 64A, 64B which it carries come into contact with the ramp 60'' of the guide cam 29 which is associated with it, in cooperation with the guide cam 29, bearing on the latter as it continues its movement on its guide 30, it raises the support 11, causing the ophthalmic lens 12 to move progressively further away from the grinding tool 13.

The movement of the application counterweight 28 continuing, its pegs 64A, 64B again move off the peak section 62 of the guide cam 29, but in the opposite direction to the preceding direction, the support 11 then returning to its initial inoperative position (FIG. 6A).

The bracket 32 which carries this support 11 then intercepting the beam of the photo-electric cell constituting the sensor 59, the power supply to the drive system 47 is interrupted in a definitive manner, the overall processing cycle being completed.

In practice, the mechanical arrangements are such that by a wedging or jamming action of the rollers 64A, 64B on the guide cam 29, the application counterweight 28 is then prevented from continuing its movement on the guide 30, stabilizing the corresponding inoperative position of the assembly.

As will have been noted, the application counterweight 28 thus of itself and during a processing cycle on one ophthalmic lens 12 ensures the lowering of the support 11 carrying the lens, the adjustment to a predetermined value of the pressure with which the ophthalmic lens 12 is applied against the grinding tool 13 concerned, and the raising of the support 11 at the end of the cycle.

In the alternative embodiment shown in FIGS. 7 through 10, the axes of the rollers 41, 42 of the notched belt 40 are horizontal, extending parallel to the plate constituting the frame 10.

This arrangement makes it possible in particular to make the roller 42, that driven by the drive system 47, larger in diameter than previously, the space available for installing this roller 42 then being greater, and thus for obtaining faster control of the application counterweight 28; conjointly, the implementation of the bracket 32 is simplified, this bracket 32 then reducing to an angle bracket of which one wing, that by which it is attached by screws 31 to the plate 15, is apertured for one of the runs of the notched belt 40 to pass through, whereas the other run of the latter extends around it.

Also, concerning the programmed controller by which the drive means for the application counterweight 28 are controlled, these may advantageously employ only one sensor 54, the member whose movement is to be detected being no longer said application counterweight 28, as previously, but a disk 70 which is constrained to rotate with the spindle of the roller 42 and which is therefore motionally coupled to the application counterweight 28 and the periphery of which, for example, features spaced notches $71_1$, $71_2$, $71_3$, $71_4$ for cooperation with the sensor 54 with which is associated a counter, at locations selected according to the halts to be provided.

The use of this embodiment is similar to that previously described.

If desired, the application counterweight 28 may also, in accordance with a further feature of the invention, provide for continuous automatic adjustment of the contact pressure of the ophthalmic lens 12 on the grinding tool 13 to a constant value, in spite of the changing radius of curvature of the edge of the ophthalmic lens 12 during the processing of the latter.

It is sufficient to appropriately program the controller by which the drive system for the application counterweight 28 is controlled and thus in practice the power supply to its drive system 47 for appropriate displacement of the applciation counterweight 28.

Figure 6D:
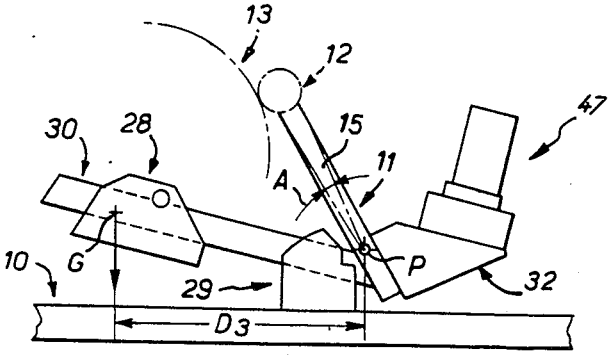
Figure 7:
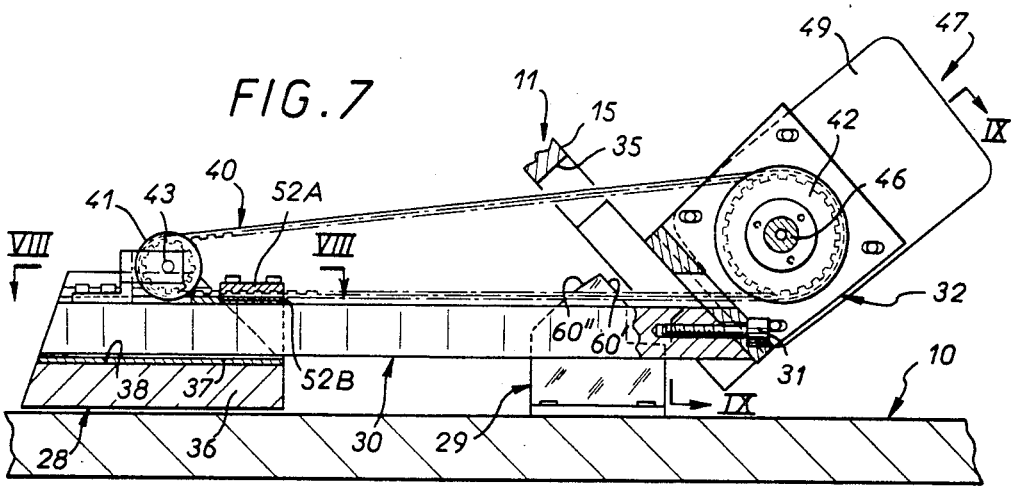
FIG. 7 is a partial view analogous to that of FIG. 2 and concerns an alternative embodiment.
Figure 8:
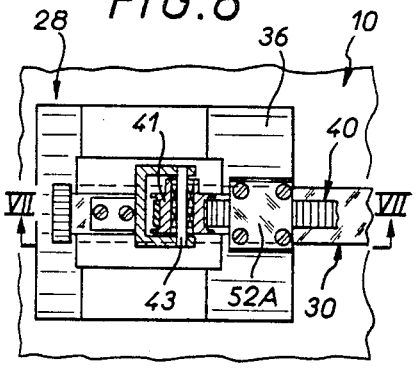
FIGS. 8 and 9 are further partial cross-sectional views of this embodiment on the lines VIII—VIII and IX—IX, respectively, in FIG. 7.
Figure 9:
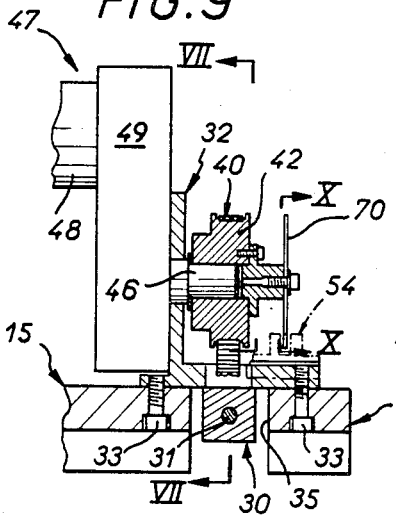
Figure 10:
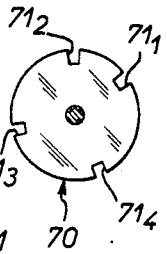
FIG. 10 is a further view of it in partial cross-section on the line X—X in FIG. 9.

In practice, the contact pressure due to the application counterweight depends on the distance $D_3$ between the vertical line passing through the center of gravity G of the latter and the pivot axis P of the support 11 which carries it, and varies with this distance $D_3$ (FIG. 6D).

Now this itself varies with the angle A by which the support 11 pivots around said axis P during one rotation on itself of the lens 12 during processing, by virtue of the variation, according to its curvature, of the distance between the center of rotation of the lens and the center of rotation of the grinding tool 13 against which it bears.

It is therefore sufficient to associate with the support 11 an angle sensor and to control the drive system which displaces the application counterweight 28 in such a way that when this angle A varies its center of gravity G remains on the same vertical line, being that on which it is located when the angle A is null.

Figure 11:
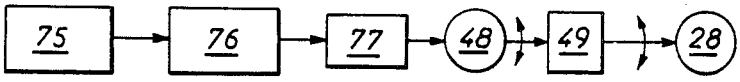
FIG. 11 is a block diagram relating to a control system which may be employed in the grinding machine in accordance with the invention.

When the motor 48 is a stepper motor, for example, the corresponding control system may be of the kind shown in FIG. 11.

This is an open-loop system.

An angle sensor 75 drives a converter 76 which converts the measured angle into a displacement and which, on the output side of a power amplifier 77, itself drives the motor 48 and thus the application counterweight 28 through the gearbox 49 in one direction or the other.

Figure 12:
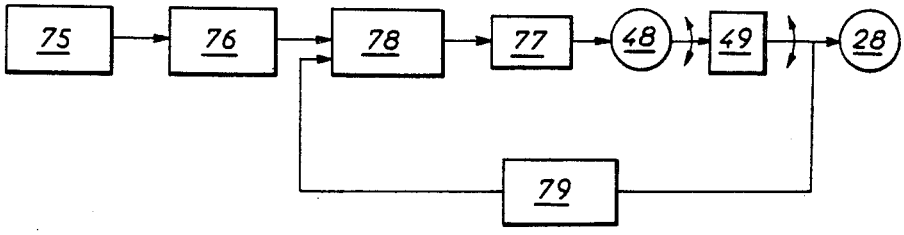
FIG. 12 is a view analogous to that of FIG. 11 and concerns an alternative embodiment.

When the motor 28 is a direct current motor, the system may be of the closed-loop type shown in FIG. 12.

On the input side of the power amplifier, a comparator 78 compares the displacement information delivered by the converter 76 and displacement information delivered by a displacement sensor 79 responsive to the displacement of the application counterweight 28 or another member motionally coupled thereto, such as the output shaft of the gearbox 49, for example and as shown here.

When the two displacement indications have the same value, the application counterweight 28 is in the correct position and the motor 48 is stopped.

The implementation of the various component parts needed is within the competence of the man skilled in the art, these components, which can be implemented in highly diverse ways, incidentally, being sufficiently defined by the function which they have to fulfill.

Thus they will not be described in detail here.

For example, the angle sensor 75 may consist of a rotary potentiometer.

Be this as it may, and as will have been understood, by virtue of the fact that the center of gravity of the application counterweight 28 is always situated in a plane which is a plane of symmetry for the planes in which are located the ophthalmic lens 12 being processed and the corresponding template 24, there is always an advantageous balance between the reaction forces to which the ophthalmic lens 12 and the template 24 are subjected through contact with their respective supports, which reduces the strain on the shaft 16A concerned.

If required, and in accordance with a further feature of the invention, means may be provided in association with the drive system for the application counterweight 28 to alter the speed of the latter on its guide 30 according to whether it is engaged with the guide cam 29 or moved away from the latter.

It is sufficient to appropriately program the controller by which this drive system is controlled.

In practice, the rate of displacement of the application counterweight 28 is preferably less when it is engaged with the guide cam 29 than when it is moved away from the latter, in order to lower the support 11 at a moderate speed at the beginning of the cycle and to raise the support 11 at a moderate speed at the end of the cycle.

For example, when the application counterweight 28 is engaged via its pegs 64A, 64B with the guide cam 29, the supply voltage applied to the drive system 47 for the application counterweight 28 might by systematically halved as compared with that when it is moved away from said guide cam 29.

It will be understood that various changes in the details, materials and arrangements of parts which have been herein described and illustrated in order to explain the nature of the invention may be made by those skilled in the art within the principle and scope of the invention as expressed in the appended claims.

There is claimed:

1. Machine for grinding ophthalmic lenses comprising a frame, a grinding tool mounted on said frame for rotation about an axis, a support for attaching an ophthalmic lens to be processed, mounting means mounting said support to said frame for pivoting about a pivot axis parallel to the axis about which said grinding tool is mounted for rotation, a counterweight received on said support and movable relative thereto in a direction orthogonal to said pivot axis, drive means controlling movement of said counterweight on said support, and a fixed guide cam fixed to said frame and arranged on the path of movement of said counterweight, follower means fixed relative to said counterweight for engagement with said guide cam for selectively raising and lowering said support to bring the ophthalmic lens into and out of position relative to said grinding wheel.

2. Machine according to claim 1, wherein said path of movement of said counterweight extends beyond said guide cam with the position of said counterweight beyond said guide cam determining the engagement pressure of the ophthalmic lens adapted to be attached to the support and said grinding wheel.

3. Machine according to claim 2, wherein said drive means are controlled by a programmable controller.

4. Machine according to claim 2, wherein said support includes a straight guide and wherein said counterweight is slidable on said guide.

5. Machine according to claim 4, wherein said support comprises a support plate and two shafts carried by said support plate for holding the ophthalmic lens to be processed and said guide extends at an acute angle relative to said plate.

6. Machine according to claim 5, wherein said pivot axis is disposed adjacent to the junction of said support plate and said guide.

7. Machine according to claim 1, further comprising means for mounting the ophthalmic lens for rotation parallel to the said axis of rotation of said grinding tool, a template contrained to rotate the means mounting the ophthalmic lens for rotation, a follower on which said template bears, wherein a transverse plane perpendicular to the support pivot axis containing the path of movement of said counterweight is centrally located between the transverse plane in which the ophthalmic lens adapted to be attached is located and the transverse plane in which said template bears on said follower.

8. Machine according to claim 1, wherein said drive means comprise a support sensor means for sensing the position of said support and disabling said drive means at the end of a cycle including movement of said counterweight in a first direction relative to said cam guide and then in an opposite direction to the first direction.

9. Machine according to claim 1, further comprising speed control means associated with said drive means for altering the rate of displacement of said counterweight depending on whether said follower means is engaged with said guide cam or not.

10. Machine according to claim 9, wherein said path of movement of said counterweight extends beyond said guide cam, the position of said counterweight beyond said guide cam determining the engagement pressure of the ophthalmic lens adapted to be attached to the support and said grinding wheel and the rate of displacement of said counterweight when said follower means is engaged with said guide cam being lower than the rate of displacement of said counterweight when it is beyond said guide cam.

11. Machine according to claim 1, wherein said guide cam is generally convex with its convex side facing away from a portion of said frame to which said cam guide is fixed, and features two ramp surfaces disposed one on each side of a common peak portion, one of said ramp surfaces being inclined towards the support pivot axis and the other away from it, said one ramp surface corresponding to a standing position of support plate and said other ramp surface corresponding to the selective raising and lowering of said support plate into and out of position relative to said grinding wheel.

12. Machine according to claim 11, wherein movement of said follower means from said peak portion along said other ramp surface away corresponds to movement from said grinding wheel, irrespective of its diameter.

13. Machine according to claim 11, wherein the position of common said peak portion is determined such that when the follower means is located at said common peak portion or along said other ramp surface the ophthalmic lens to be processed is maintained out of contact with said grinding wheel irrespective of its diameter.

14. Machine for grinding ophthalmic lenses comprising a frame, a grinding tool, a support to which an ophthalmic lens to be processed may be attached pivoted to said frame about an axis parallel to the axis of said grinding tool, a counterweight on said support movable relative thereto in a direction orthogonal to said pivot axis, drive means controlling movement of said counterweight, and a guide cam supported by said frame on the path of movement of said counterweight, follower means fixed relative to said counter weight for engagement with said guide cam for selectively raising and lowering said support, a straight guide carried by said support, and said counterweight being slidable on said guide, and further comprising power supply means for said drive means, a drive shaft driven by said drive means, a drive roller constrained to rotate with said drive shaft, an idler roller freely rotatable on an end of said guide, and a belt passing around said drive and idler rollers, said belt being in motion transmitting engagement with said counterweight.

15. Machine according to claim 14, wherein said belt is a notched belt and said counterweight comprises two jaws between which said belt passes and one of which has a notched profile complementing to that of said belt.

16. Machine according to claim 14, wherein said drive means are controlled to claim 14, wherein said drive comprises at least one sensor disposed on the path of movement of said counterweight or of another member motionally coupled to said counterweight, adapted to sense movement of said counterweight or said other member and adapted to disable temporarily said drive means power supply means when said power supply means have been activated beforehand.

17. Machine according to claim 16, wherein said drive means comprise a plurality of sensors disposed along the path of movement of said counterweight and connected in parallel to said power supply means for said drive means, and a respective selector for each of said sensors selectively operable by an operator and governing operation of the respective sensor.

18. Machine according to claim 16, wherein said drive means comprise a single sensor and a counter and further comprising a notched disk constrained to rotate with said drive shaft and constituting said other member motionally coupled to said counterweight.

19. Machine for grinding ophthalmic lenses comprising a frame, a grinding tool, a support to which an ophthalmic lens to be processed may be attached pivoted to said frame about an axis parallel to the axis of said grinding tool, a counterweight on said support movable relative thereto in a direction orthogonal to said pivot axis, drive means controlling movement of said counterweight, and a guide cam supported by said frame on the path of movement of said counterweight, straight guide carried by said support and said counterweight is slidable on said guide, and further comprising two flanges projecting from said frame on respective opposite sides of said guide, wherein said guide cam is formed by the edges of said flanges and wherein said counterweight comprises two projecting pegs engageable with said edges of said flanges.

* * * * *